US008490212B1

(12) United States Patent
Asher et al.

(10) Patent No.: US 8,490,212 B1
(45) Date of Patent: Jul. 23, 2013

(54) QUICK RELEASE GARMENT

(75) Inventors: Matthew Asher, Imperial, MO (US); Carl James Quinlan, Maysville, NC (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 1899 days.

(21) Appl. No.: 11/671,068

(22) Filed: Feb. 5, 2007

(51) Int. Cl.
*F41H 1/02* (2006.01)

(52) U.S. Cl.
USPC ..... 2/2.5; 2/462

(58) Field of Classification Search
USPC ..... 2/2.5, 455, 462–465, 467
See application file for complete search history.

(56) References Cited

U.S. PATENT DOCUMENTS

| | | | | |
|---|---|---|---|---|
| 761,113 | A | | 5/1904 | Van Wagoner et al. |
| 842,498 | A | | 1/1907 | Schmidt |
| 1,776,044 | A | | 9/1930 | Roehm |
| 2,148,152 | A | | 2/1939 | Dosberg |
| 2,343,142 | A | | 2/1944 | Freedman |
| 2,442,895 | A | | 6/1948 | Hill |
| 2,654,964 | A | | 10/1953 | Stoll |
| 3,934,848 | A | | 1/1976 | Snyder |
| 4,044,478 | A | | 8/1977 | Girard |
| 4,117,609 | A | | 10/1978 | Helt |
| 4,262,865 | A | | 4/1981 | Smith |
| 4,497,069 | A | | 2/1985 | Braunhut |
| 4,545,773 | A | | 10/1985 | Evert |
| 4,697,285 | A | | 10/1987 | Sylvester |
| 5,060,314 | A | | 10/1991 | Lewis |
| 5,259,093 | A | | 11/1993 | D'Annunzio |
| 5,331,683 | A | * | 7/1994 | Stone et al. ..... 2/2.5 |
| 5,495,621 | A | | 3/1996 | Kibbee |
| 5,512,348 | A | | 4/1996 | Mazelsky |
| 5,516,234 | A | | 5/1996 | Duchesne |
| 5,724,707 | A | | 3/1998 | Kirk et al. |
| 5,785,011 | A | | 7/1998 | Gitterman, III |
| 5,806,740 | A | | 9/1998 | Carlson |
| 5,897,468 | A | | 4/1999 | Lumpkin |
| 5,966,747 | A | | 10/1999 | Crupi et al. |
| 6,029,270 | A | | 2/2000 | Ost et al. |
| 6,035,452 | A | | 3/2000 | Braxton |
| 6,098,196 | A | | 8/2000 | Logan |
| 6,138,277 | A | * | 10/2000 | Gillen et al. ..... 2/102 |
| 6,164,048 | A | | 12/2000 | Rhodes |
| 6,185,738 | B1 | | 2/2001 | Sidebottom |
| 6,308,334 | B1 | | 10/2001 | Maas |
| 6,421,833 | B2 | | 7/2002 | Khanamirian et al. |

(Continued)

FOREIGN PATENT DOCUMENTS

| | | |
|---|---|---|
| CA | 642244 | 6/1962 |

OTHER PUBLICATIONS

Point Blank Body Armor, Inc., Nato QR Full Spectrum Battle Equipment, web site printout dated Nov. 5, 2003.

(Continued)

*Primary Examiner* — Katherine Moran
(74) *Attorney, Agent, or Firm* — Husch Blackwell LLP

(57) ABSTRACT

A quick release garment such as a tactical vest wherein the garment includes a waist belt that is provided with two connector systems, one for manual release of the belt and one for remote release of the belt. The vest may include armor that is generally conformable to the waist shape of a wearer, which armor is insertable within the waist belt of the garment.

36 Claims, 6 Drawing Sheets

U.S. PATENT DOCUMENTS

| | | | |
|---|---|---|---|
| 6,769,137 | B2 | 8/2004 | D'Annunzio |
| 6,948,188 | B2 | 9/2005 | D'Annunzio |
| 7,020,897 | B2 | 4/2006 | Johnson |
| 7,047,570 | B2 | 5/2006 | Johnson |
| 2007/0107109 | A1 | 5/2007 | Johnson |

OTHER PUBLICATIONS

U.S. Army Natick Soldier Center, USMC Full Spectrum Battle Equipment, web site printout (several views are included). This body armor/vest is believed to be the vest produced by Point Blank Body Armor, Inc.

Attachment A1-A8 show Point Blank Body Armor, Inc., Nato QR Full Spectrum Battle Equipment, Digital photograph with details of cable release system using multiple cables taken Jul. 2004.

Figures B1-B3, for Cut Away Vest (digital photographs). Attachment B is a prior art vest. It includes a four cable release system to effect cut away of the vest Fig. B1. The shoulder straps each have a cable connection Fig. B3 and the sides each have a cable connection Fig. B2. The four cable connections are similar in construction. The vest has been referred to as a FSBE I vest.

Figures C1-C7, for Cut Away Vest (digital photographs). Attachment C shows a TAC-VDG vest that went through several design changes, six versions were believed to have been designed. It is not clear which version the illustrated vest is. One version (unknown) which was sold on or about Jun. 18, 2002. Fourteen units of version four were sold on Oct. 20, 2002. The specific design of what was sold is currently unknown. The shoulders were each joined by a respective cable, Fig. C2 and the belt or sides and cummerbund were connected by a third cable Fig. C3.

Figures D1-D6 illustrate the Dap vest discussed in the background of the subject application. The vest shown has an ID tag claiming a manufacture date of 1990 and denotes the vest as Model A1-IIIA and named A1-TAC-DPSO. Figures D1-D6 show the vest from the front side. Figure D1 shows the cable in the retaining loops closing the armor pocket. Figure D2 shows the cable removed and the loops out of their grommets. Figure D3 shows the cable removed and the loops out of their grommets. Figure D4 shows the vest with the cable installed and the closure flap closed. Figure D5 shows the exterior of the vest with the cable installed. Figure D6 shows an enlargment of the vest label on the body side of the vest denoting American Body Armor & Equipment, Inc. as the source of the vest.

Attachments E1-E11 show what is believed to be an M1 flak jacket used in the latter part of World War II by American flyers. This flak jacket utilized a pull cord as seen in Attachment E3 that when pulled separates snaps as seen in Attachments E1 and E2 allowing the flak jacket to fall downwardly off the wearer in the event the wearer needs to ditch the flak jacket in an emergency situation. The flak jacket included armor plates to protect the wearer. Apparently, the armor stayed with the various portions of the flak jacket when the vest was released from the wearer. Attachment E11 shows the flak jacket from the rear and Attachments E1-10 show the flak jacket from the front.

Attachments F1-F4 show World War II flak jackets including the M1 flak jacket and the M12. It is not clear from the photos what the construction of the M12 jacket includes. The Attachment F3 appears to show the M1 flak jacket as it would be released from the wearer.

Attachment G1-G10 illustrates a releasable vest apparently produced by Point Blank Body Armor, Inc. Attachment G3 describes the vest as being designed for quick release. Structural details of the vest are not disclosed in the article. There is a reference in Attachment G3 about the vest having a quick ejection hard armor plate pocket.

* cited by examiner

QUICK RELEASE GARMENT

BACKGROUND OF THE INVENTION

Load bearing garments such as vests and packs are often worn by people who encounter situations where the garment needs to be either partially or completely removed. Such situations include an injury to the wearer where access needs to be gained to the site of the injury, often times under the garment, where the weight of the garment and supplies/equipment have become an encumbrance, for example on the battlefield. The garment may also become engaged with another item inhibiting movement of the vest wearer thereby necessitating partial or total removal of the garment. Such garments may be used for carrying equipment, supplies and/or armor. So called cutaway vests are known in the industry, and provide an improvement over non cutaway vests, at least in certain regards. Such a vest may be found in U.S. Pat. No. 7,047,570 which provides an advance in the art by having a quick release mechanism that permits quick jettisoning of the vest in separate components wherein the front panel and rear panel can separate from one another. While providing an advance in the art, complete separation of the vest into separate components for removal is not always necessary or desirable, particularly on the battlefield where both the wearer and the medic attending to the wounded wearer of the garment are subject to hostile fire. Additionally, such vests, to provide efficiency in manufacture and inventory control, should be adjustable within ranges for size adjustment for different wearers, by providing adjustment at the shoulders for height and by providing adjustment for waist size to better accommodate different wearers, comfort levels and perhaps different types of clothing to be worn under the vest.

While such a cutaway vest has provided an advance in the art of vest design, reassembly after cutaway can be problematic and time consuming. It can take several minutes to reassemble a vest for wearing which may exacerbate a situation in which a wearer is using the vest such as in a hostile fire environment.

It would therefore be desirable to provide an alternative vest design, which permits easy to effect alternative rigging configurations, one for remote quick release of the vest from a wearer while maintaining the parts connected and while permitting size adjustment in a simple and effective manner, and one for manual release of the garment. There is also a need for a vest having additional armor carrying capability to enhance the user's safety without having to make major modifications to current garment constructions.

Thus, there is a need for an improved vest or other form of releasable garment.

SUMMARY OF THE INVENTION

The present invention involves the provision of a releasable garment, for example a vest, which has at least one torso panel and a waist belt along with shoulder straps to support at least some of the weight of the garment on the shoulders of the garment wearer. When the garment is a vest, there is provided a front torso panel, a rear torso panel, strap members extending between the front and rear torso panels to provide shoulder straps, and a belt, for securing lower portions of the front and rear torso panel in position on the vest user. The vest includes a remotely activatable release system that works in combination with first and second connector systems. The first connector system is adapted for attaching the first and second end portions of a belt together in a manual release mode and a second connector system is adapted for alternately attaching the first and second belt end portions together in a quick release mode. When attached in the quick release mode, the quick release system is operable for disconnecting the belt end portions from attachment such that the front torso panel may be moved relative to the user to either remove the vest completely or to move portions of the vest to provide access to normally covered areas of the vest user. The shoulder straps may remain attached to both the front and rear torso panels retaining them connected together after release for quick remounting of the garment.

The present invention also involves the provision of a mounting system for carrying soft armor in lower portions of the garment, and in particular around the waist of the garment user in a manner that allows selective use of the armor.

BRIEF DESCRIPTION OF THE DRAWINGS

Like numbers throughout the various figures designate like or similar parts or construction.

DETAILED DESCRIPTION

The following detailed description and associated drawings of the present invention are related to certain embodiments or implementations of the invention. Accordingly, the following description and associated drawings do not describe every conceivable and possible embodiment or implementation of the invention. Those of ordinary skill in the art, given the teachings herein, will recognize that aspects of the present invention may be changed or otherwise adapted to best-fit a particular implementation of the present invention.

Figure 1:
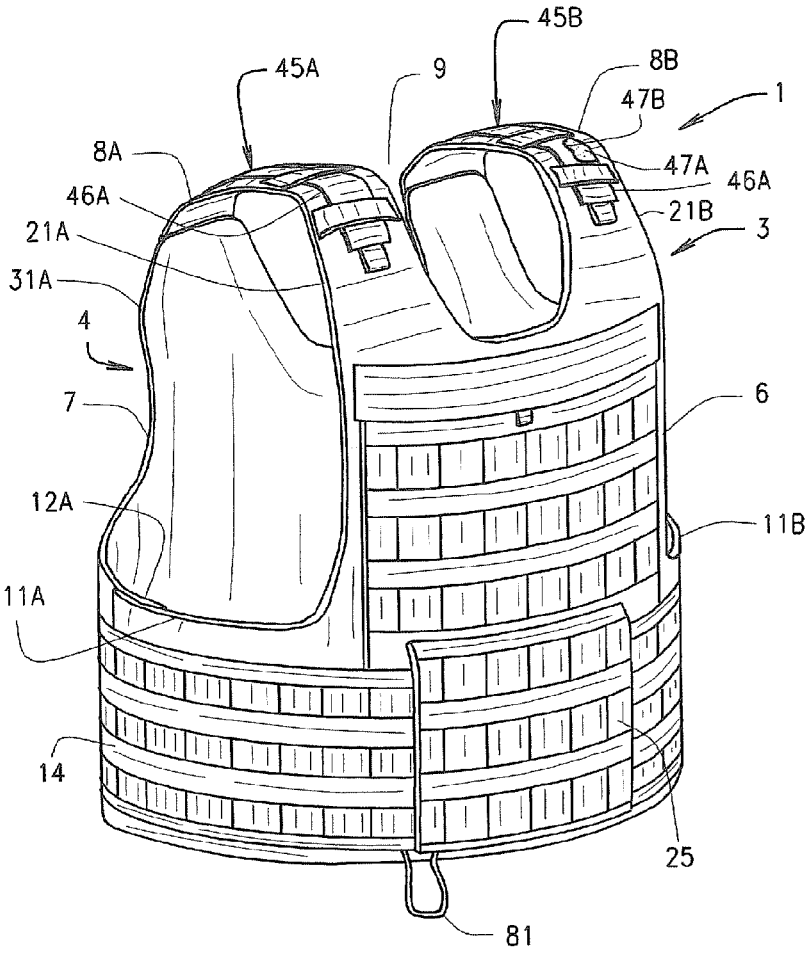
FIG. 1 is a perspective view of a typical quick release garment in the form of a vest, as seen generally from the front of the vest, constructed in accordance with the teachings of the present invention.

The reference numeral 1 in FIG. 1 designates generally a quick release garment which is shown in the form of a vest having a front torso member 3 and a rear torso member 4. The front torso member 3 includes a front torso panel 6 and the rear torso member 4 includes a rear torso panel 7. Shoulder strap assemblies 8A and 8B extend between portions of the front and rear torso members 3 and 4 to connect the upper portions thereof together and define a neck opening 9 therebetween. The front torso member 3 preferably has rearwardly extending side portions 11A and 11B extending toward the rear torso member 4. The rear torso member 4 includes forwardly extending side portions 12A and 12B which may overlap portions of the front extending side portions 11A and 11B, either internally or externally thereof. The garment 1 further includes a waist belt or other similar member such as a cummerbund designated generally 14 which extends around at least a substantial portion of the lower portion of the garment 1 and preferably overlies the front and rear side portions 11 and 12 providing a connection between the front and rear torso members at lower portions thereof.

The garment 1 is provided with at least one connector system for connecting portions of the garment together in at least two release modes including a manual release mode and/or a quick release mode as described below. A quick release connector system, designated generally 16 (FIGS. 6 and 7), is provided to selectively effect separation of portions of the belt member 14 from one another. Another connector system designated generally 18 (FIG. 6) is provided for selectively securing rear portions of the waist belt 14 together for operation in either a manual release mode or a quick release mode. An armor system designated generally 20 (FIGS. 5 and 6) may also be incorporated into the belt member 14 for providing protection around the waist area of the vest user.

Figure 2:
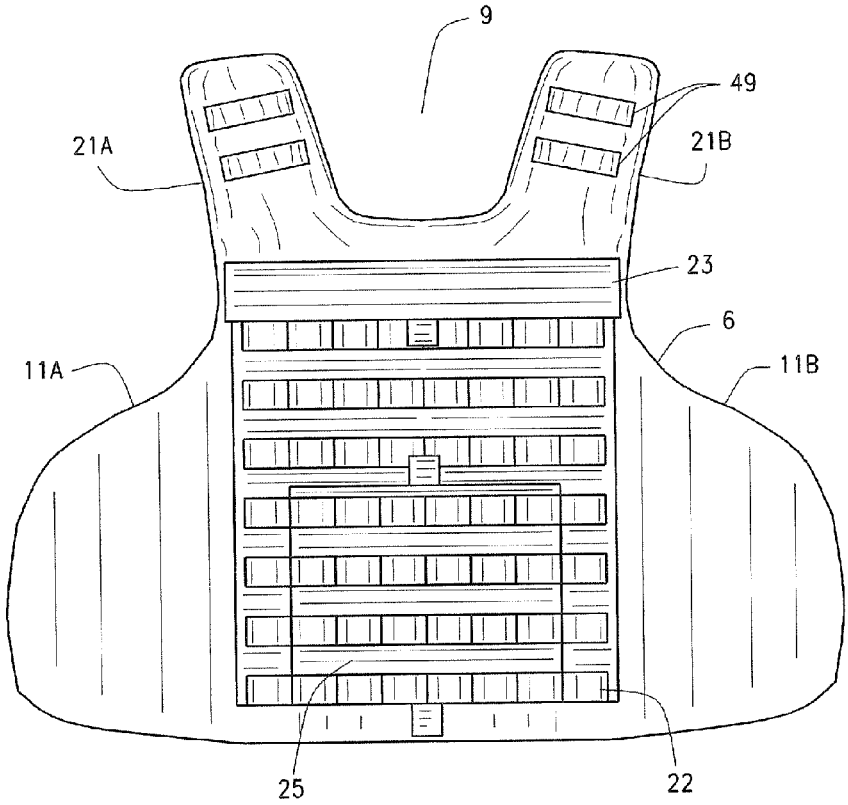
FIG. 2 is an elevation view of the front torso member of the vest of FIG. 1 with portions in an extended condition to show details.
Figure 5:
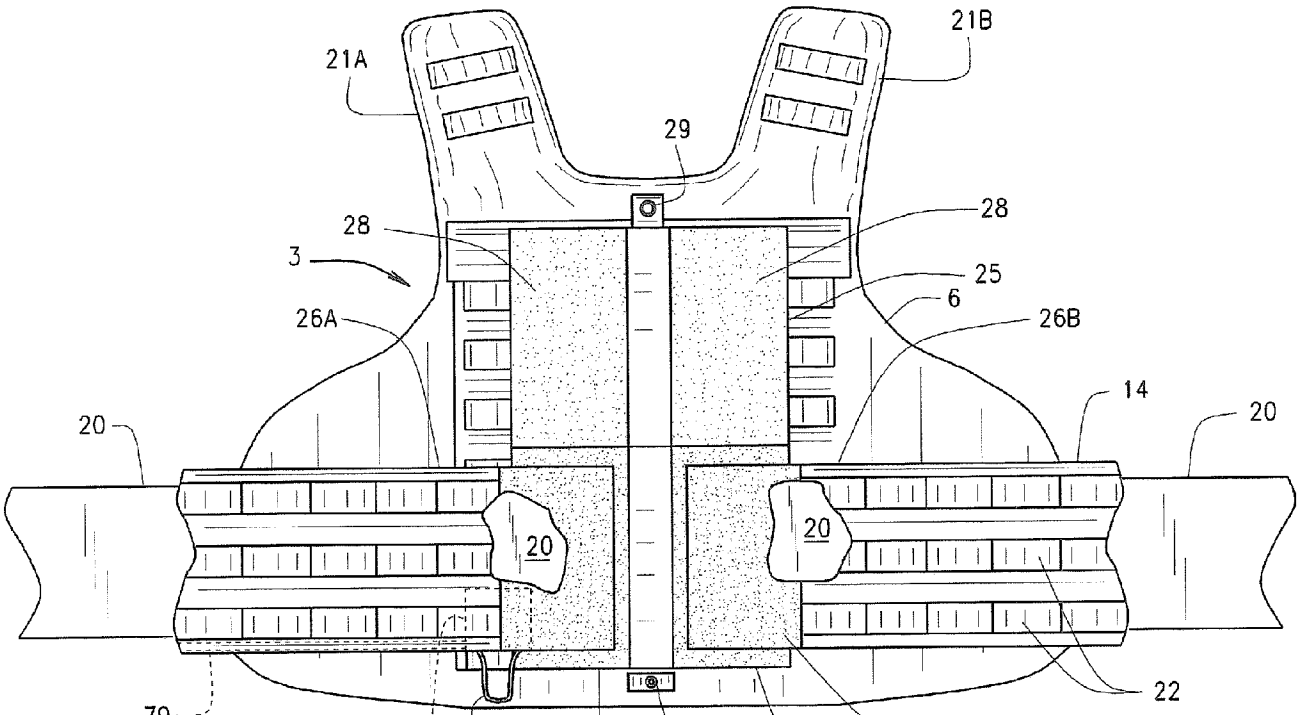
FIG. 5 is an elevation view of the front torso member similar to FIG. 2 showing the waist belt attached to the front panel and a cover shown in an up position.

The front torso member 3 includes the torso panel 6 and rearwardly extending side portions 11A and 11B. The front torso member 3 also includes, in the illustrated structure, portions of the shoulder strap assemblies 8A and 8B which are in the form of generally upwardly and rearwardly extending ears 21A and 21B (FIG. 2) which, in use, extend over a user's shoulders and help define the opening 9 at the front portion thereof. The front torso member 3 is preferably made from woven fabric such as nylon or polypropylene, although any suitable material based upon the particular application may be used. The front torso member 3 may be provided with a plurality of rows or series of loops 22, which loops can be both horizontally and vertically aligned to provide means for attaching equipment to the garment 1, which loop system is commonly known as a Molle System. The loops 22 may be formed by attaching webbing to the front torso panel 6. A pocket (not shown) accessible through a cover 23 (FIG. 2) may be provided on the exterior for storing items inside the garment 1. The interior surface of the front torso member 3 may be provided with an open weave material to provide ventilation and comfort for the garment user. As seen in FIGS. 1, 2 and 5, the front torso member 3 may be provided with a selectively movable cover 25 which may be used to cover front positioned end portions 26A and 26B of the belt member 14. The cover 25 is in an up position in FIG. 5. The end portions 26A and 26B of the belt member 14 may be provided with attachment devices for example hook and loop members 27 that can interengage with cooperating hook and loop members 28 secured to the cover 25 for securing the waist belt in place on the front torso member 3 and still provide both adjustment of length and easy attachment and removal. The use of the cover 25 can help prevent accidental release of the belt ends 26A and 26B. One or more secondary closure devices 29, such as a snap fastener, may be provided to help secure the cover 25 in place. The front torso member 3 may also be provided with an inside pocket (not shown) for holding hard armor.

Figure 3:
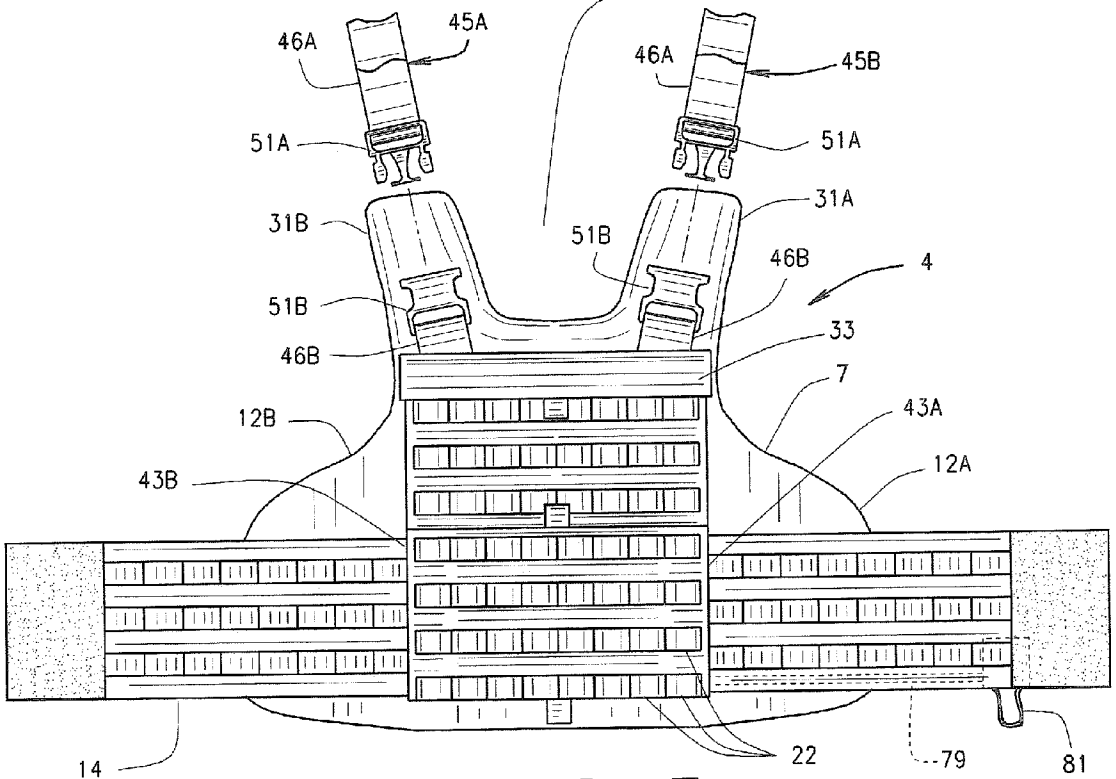
FIG. 3 is an elevation view of the rear torso member of the vest of FIG. 1 shown laid out with portions in an extended condition to show details.
Figure 6:
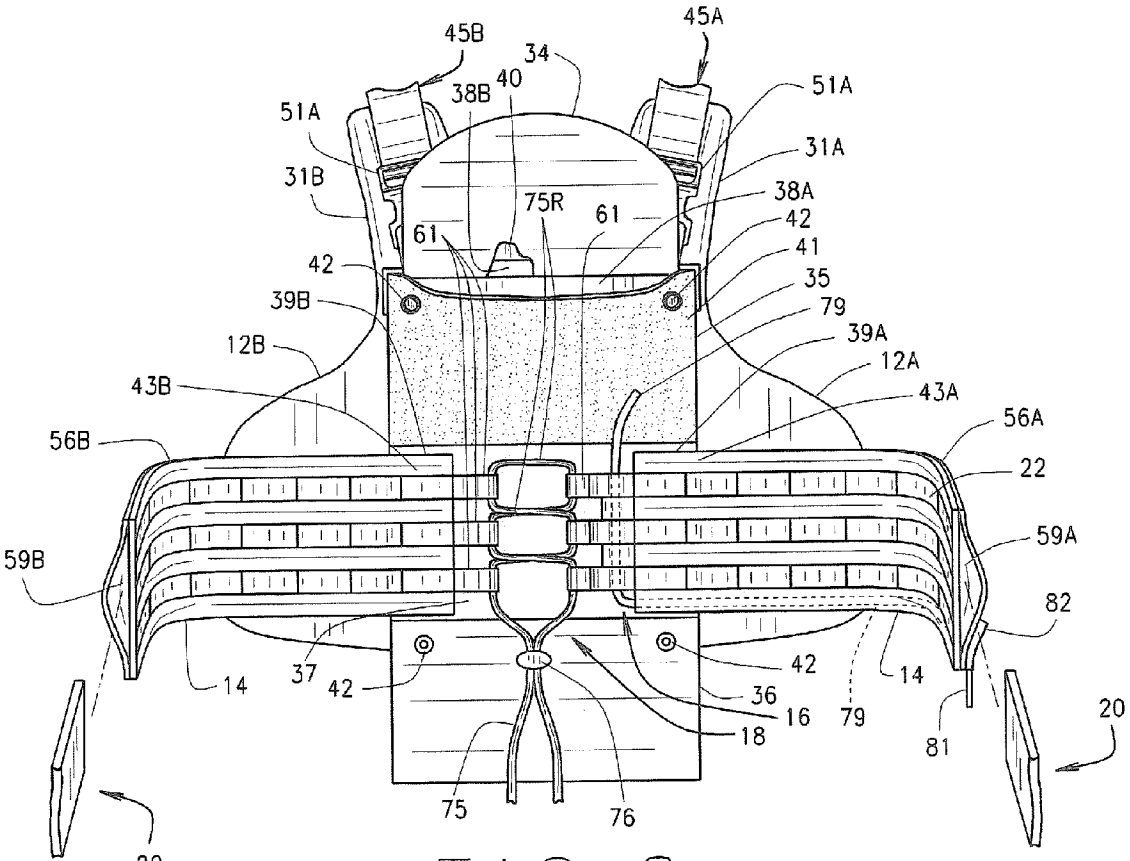
FIG. 6 is an elevation view of the back torso panel member showing the waist belt attached, belt covers in their respective up and down positions, with portions of the waist belt reverse bent to show details of a sleeve within the waist belt.

The rear torso member 4 includes the rear torso panel 7 and the forwardly extending side portions 12A and 12B. At the upper portion of the torso panel 7, there are two generally upwardly and forwardly extending ears 31A and 31B (FIGS. 3, 4 and 6) which are connected to and extend upwardly therefrom generally to be in overlapping relationship with portions of the ears 21A and 21B respectively. The ears 31 define rear portions of the opening 9. The ears 21 and 31 can be padded for comfort and, as shown, form portions of the shoulder strap assemblies 8A and 8B. The rear torso member 4 is preferably made from woven fabric, for example, nylon or polypropylene or other suitable materials and can be in multiple layers. A pouch (not shown) may be provided and may be accessed through the cover 33 (FIG. 3). The interior of the rear torso member 4 may be lined with a mesh lining to provide for ventilation and comfort. An armor pocket (not shown) may also be provided in the rear torso member for holding suitable armor, for example, hard armor, if desired. The rear torso member 4 may likewise be provided with the plurality of rows and columns of loops 22 to provide means for attachment of equipment, pouches or the like as do the loops 22 associated with the front torso member 3. As best seen in FIG. 6, covers 35 and 36 can be provided to foam a double open end pouch 37 for receipt therein of rear positioned end portions 39A and 39B of belt member 14. The cover 35 may be provided with a pouch 38A and a flap 34 which may also include a pouch 38B therein for storing items or armor 40 in the cover 35. When used for armor, the flap 34 may be exposed and depend below a lower portion of the vest 1 to provide groin area protection from the rear. The cover 35 preferably overlies the cover 36 to form pouch 37 between cover 36 and portions of the rear torso panel 7 and can be secured thereto with suitable fasteners such as hook and loop fasteners 41 with one portion being mounted to the inside of the cover 35 and one portion being mounted to the exterior of the cover 36 and with mechanical fasteners such as snap fasteners 42. The pouch 37 has opposite open ends 43A and 43B each for receipt of a respective belt end 39A and 39B, which open ends 43 are formed when the covers 35 and 36 are in their closed configuration as seen in FIG. 3. The pouch 37 is axially aligned with the belt end portions 39A and 39B.

Figure 4:
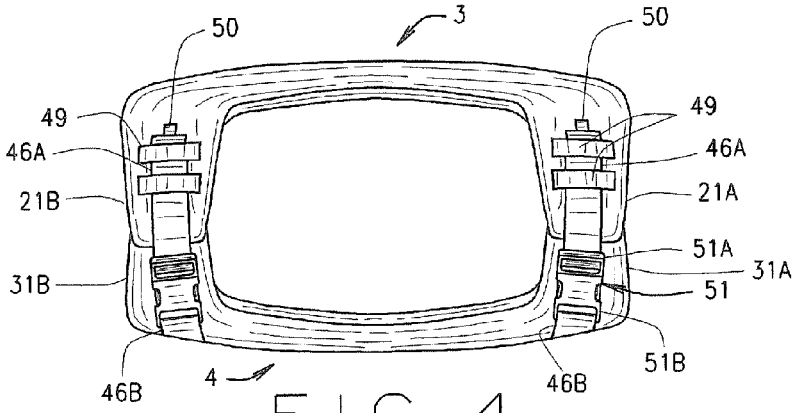
FIG. 4 is a top plan view of the vest of FIG. 1 shown assembled.

The shoulder strap assemblies 8, as shown, include portions of the front and rear torso members 3 and 4, that is, the ears 21 and 31 which can provide cushioning and underlie shoulder strap members 45A and 45B (FIGS. 3 and 6). In the illustrated structure, the shoulder straps 45 are formed from webbing such as woven or knit webbing. In a preferred embodiment, each strap 45 has a pair of releasably connected portions 46A and 46B which are secured to the front torso member 3 adjacent to or on the ears 21 and the rear torso member 4 adjacent to or on the ears 31, respectively. The securement can be a permanent, releasable or a combination of permanent and releasable securement. As shown, one end 46A of a strap 45 is doubled over having one end secured to an ear 21 as by stitching and has a first hook or loop fastener element 47A secured thereto and the other end of strap portion 46A is free having a second hook or loop fastener element 47B secured thereto and attachable to the first hook or loop fastener element 47A forming a doubled over strap portion 46B with adjustable length (FIG. 1). As seen in FIGS. 3, 4 and 6, the straps 45 each have a suitable connector 51 for releasably connecting the strap portions 46A and 46B together. As seen, each of the straps 45 has a suitable connector 51, such as a side release buckle, having components 51A and 51B cooperatively connecting the strap portions together at the rear torso member 4. The connector component 51A is secured to a front portion 46A of the strap 45 while the fastener component 51B is secured to the rear torso member 4 via the rear portion 46B. The strap 45 is configured with the component 51A to provide for length adjustment of the strap 45. The fastener component 51B is in turn secured to the front portion 46A of a respective strap 45 by releasable coupling with the respective fastener component 51A. Hold downs 49 may be secured to the front torso member 3 to be in overlying relationship to a respective strap portion 46A to prevent accidental separation in the event hook and loop fasteners are used. Tabs 50 can be provided to help effect release of the strap portions 46A from engagement to the front torso member 3 if hook and loop fasteners are used for securement. Although a specific shoulder strap configuration is illustrated and disclosed herein in FIGS. 1-6, it is recognized and understood that any shoulder strap configuration can be used in conjunction with the present invention.

The belt member 14, as illustrated, can also be provided with a series of horizontally and vertically positioned rows or series of loops 22 for securement of items and pouches to the belt 14 as do the loops 22 associated with the front and rear torso members 3 and 4 respectively. The belt member 14 has two side portions 56A and 56B with each side portion 56 having opposite ends whereby the belt 14 can be separated into two separate parts. The ends 26A and 26B are the front positioned ends of the sides 56A and 56B, respectively, while the ends 39A and 39B are the rear positioned ends of the sides 56A and 56B respectively. The belt member 14 is preferably provided with longitudinally extending sleeves or pouches 59A and 59B preferably extending from adjacent the ends 26A and 26B toward the ends 39A and 39B for receipt therein of armor members or segments 20 which are preferably soft an nor, for example, Kevlar® based armor that is generally comformable to the shape of a user's waist, which minor members are well known in the art.

Figure 7:
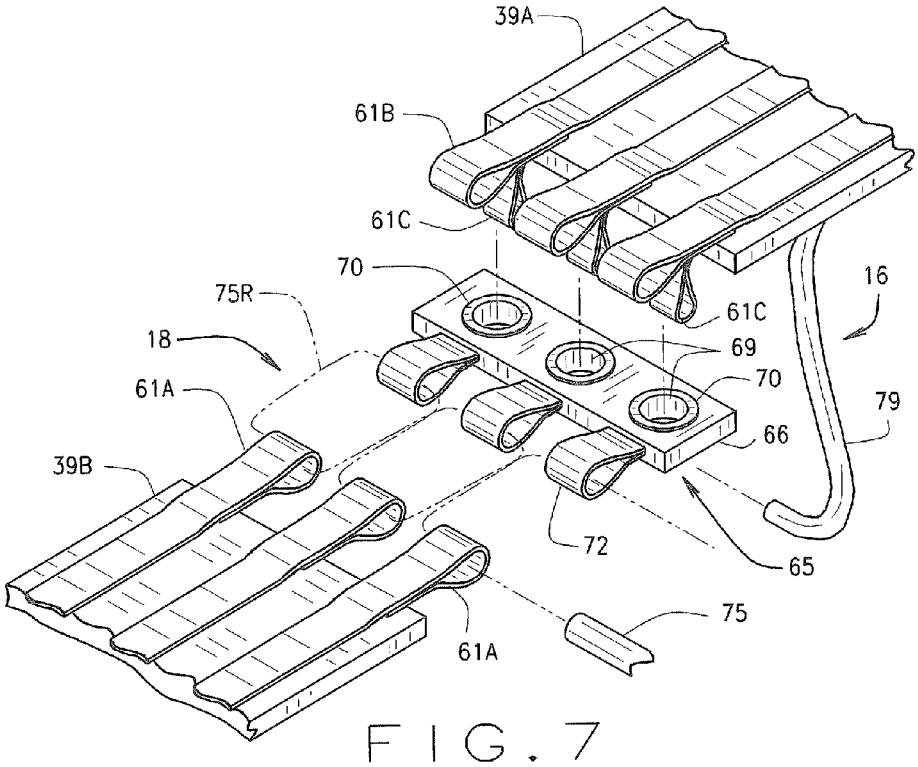
FIG. 7 is an enlarged fragmentary perspective view of ends of the waist belt at the rear torso panel showing details of the attachment points therebetween.
Figure 8:
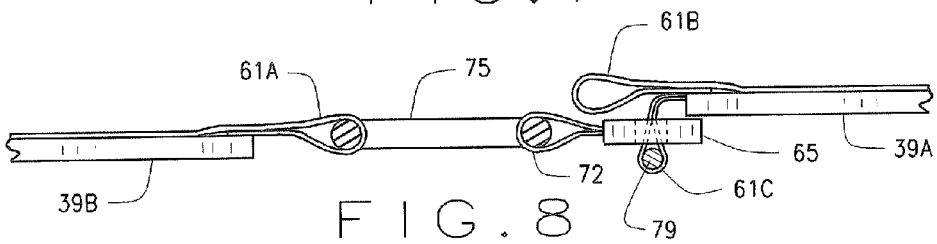
FIG. 8 is a bottom plan view of the connectors shown in FIG. 7 showing the connectors in a releasable attachment configuration.
Figure 9:
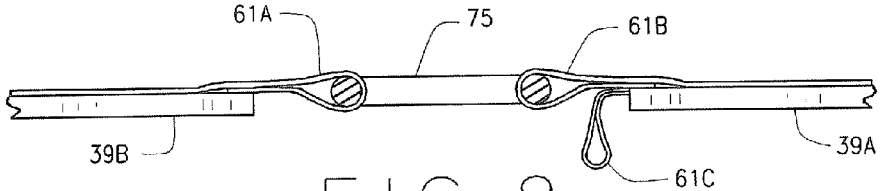
FIG. 9 is a bottom plan view similar to FIG. 8 but showing the waist belt end portions attached in a manual release configuration.

Secured to the belt sides 56A and 56B adjacent the belt ends 39A and 39B are connector devices, for example, sewn fabric loops 61 which are best seen in FIGS. 6 and 7. The loops are designated 61A and 61B for convenience but are of similar or the same construction. In a preferred embodiment, there are three loops 61 on each of the belt ends 39A and 39B and the loops 61 are in a generally axially aligned orientation relative to the loops on the other belt end and to each other on each of the ends. As best seen in FIG. 7, the belt end 39A has an additional set of loops 61C, each loop 61C being adjacent a respective loop 61B for providing alternate means of fastening the belts ends 39A and 39B together either in a quick release manner or a manual release manner as described below. An attachment device or adapter member 65 is provided for an alternate mode of attachment to secure the belt ends 39A and 39B together in a quick release manner in cooperation with a portion of the quick release means 16 for remote location release activation by the user or another person, e.g., a medic. The attachment device 65 in the illustrated structure includes an elongate member 66 which can be in the form of heavy fabric webbing having a plurality of connector devices or elements adjacent one end of the adapter, such as the apertures 69 formed therein which can be formed by metal eyelets 70 extending therethrough, or other suitable means. The member 65 is also provided with the plurality of connector devices such as loops 72 adjacent the other end of the adapter, for example sewn fabric loops, which are also spaced approximately the same as the loops 61A and are axially aligned therewith.

As best seen in FIGS. 6-9, there are two alternate means of attaching the belt ends 39A and 39B. For a manual release attachment, see FIG. 9, a manual release connector system includes an attachment device, such as a cord 75 illustrated in FIG. 6, is laced through the loops 61A and 61B in a crossing pattern forming cord runs 75R therebetween as best seen in FIG. 6. A fastener 76, such as a cord lock in the form of a barrel lock, is operatively associated with the cord 75 to prevent accidental loss of the cord from engagement with the loops 61A and 61B. In a preferred embodiment, the cord 75 is a flexible stretch cord and can provide a certain amount of give or stretch in the waist belt 14 during its use. The length of the belt member 14 can also be adjusted by the length of the cord 75 that is contained between all of the loops 61A and 61B. The longer the cord 75 contained between the loops, the longer the belt 14. The fastener 76 fixes the length of the cord engaged within the loops 61A and 61B. Release of the belt 14, when the loops 61A and 61B are connected, can be accomplished by either disconnecting the front portions of the belt 26A and 26B from the front member 3 or by unlacing the cord 75 from the loops 61A and 61B, both methods being a manual release.

For rigging the belt member 14 for a quick release, the loops 61C are placed through a respective aperture 69 and releasably locked to the adapter member 65 by use of a portion of the quick release system 16 for remote quick release, that is, remote from the loops 61 or the point or points of attachment. In the illustrated structure, the quick release connection system 16 includes a retainer member such as a plastic coated metal wire cable 79 or any other suitable member that preferably extends from adjacent the front portion of the front torso member 3 through the belt section 56A, or alternately the belt section 56B, and into the pouch 37 for extending through the loops 61C to lock each of the loops 61C extending through a respective aperture 69. This rigging secures the adapter member 65 to the belt end 39A and the belt ends 39A and 39B together in a quick release manner. The loops 72 are then substituted for the loops 61B having the cord 75 laced therethrough as described above for the lacing of the loops 61A and 61B, that is, the loops 61A and 72 are now laced together with the cord 75 as previously explained. To affect quick release, the cable 79 is removed from the loops 61C by pulling a handle 81 which in turn is secured to the cable 79. The handle 81 can include a fastener 82 (FIG. 5) such as a hook and loop fastener device associated preferably with an inside portion of the belt section 56A. By removing the cable 79 from the loops 61C, the belt ends 39A and 39B can separate from one another allowing the front torso member 3 to be moved relative to the rear torso member 4 at the lower portions thereof to lift the vest off a user or to raise the front or rear panel of the vest to provide access to the mid torso section of the vest user. In the event a vest user is face down, the belt ends 39A and 39B may be separated by releasing covers 35 and 36 and pulling the distal end portion of cable 79 out of the loops 61C. With the attachment of the belt ends 39A and 39B at the rear torso panel 7, the quick release system 16 provides for remote activation by having the handle 81 positioned at the front torso panel 6 with the cable 79 being carried preferably in a sleeve in the interior of the belt side 56A. The sleeve, not shown, can be positioned within the pouch 59A. The track of the cable 79 is shown in dash lines in FIG. 6. While the handle 81 is shown as being located on the front torso member and the points to be released by the quick release system are located on the rear torso panel, it is to be understood and recognized that the quick disconnect points that are on the rear torso panel could be located on the front torso panel and still permit remote release by use of the handle even though the two sets of components are located closer to one another. In this event, the attachment device or adapter member 65 and loops 61A, 61B and 61C would be associated with belt ends 26A and 26B. It is also recognized that the handle 81 can be located anywhere on the vest 1 other than the location illustrated in FIGS. 1 and 5. The use of the cord 75 with the fastener 76, which can be in the form of a barrel lock, permits manual release of the belt ends by removal of the cord 75. Such release method means that the covers 35 and 36 need to be moved to an open position exposing the cord 75. Use of the quick release system eliminates the moving of the covers 35 and 36 to their open configuration as seen in FIG. 6 when the handle 81 is used.

Although member 14 has been described or called a waist belt, the member 14 could also be a cummerbund and use of the term "waist belt" is meant to include any member which fits around the waist of the user such as an internal or external belt or cummerbund member typically associated with a garment or vest of the type disclosed herein.

It is recognized and anticipated that the various components and elements comprising the present connector systems such as the members 61, 65, 69, 72, 75, 79 and 81 can take on a wide variety of different shapes and dimensions yet still accomplish the stated purpose. For example, although the attachment device or adapter member 65 is illustrated as having openings 69 and loops 72 associated therewith, it is recognized and anticipated that other connection devices or connection means can be utilized in association with the waist belt end portions 38A and 38B to effect operable connection therebetween. It is also recognized that the loops 61A, 61B, 61C and 72 could be apertures and that the apertures 69 could be loops. Likewise, still other connection devices instead of the loops and apertures disclosed herein could be utilized to accomplish the same task. Still further, it is likewise recognized and understood that other attachment devices instead of the cord member 75 could likewise be utilized to accomplish connection between the adapter member and one end portion of the waist belt. In addition, although the garment 1 is disclosed as being a vest having front and rear torso members 3 and 4 respectively, it is likewise recognized and anticipated that a garment utilizing the present invention may utilize one or more torso members, for example, the garment could be a back pack having a waist belt associated therewith, the back pack having only a rear torso member associated therewith. It is also recognized and anticipated that a garment utilizing the present invention may eliminate use of the manual release system and may incorporate just the quick release connector system disclosed herein. Still other variations and modifications to the various constructions illustrated herein are contemplated including equivalents thereof.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A garment comprising:

a front torso panel;

a rear torso panel;

a pair of shoulder straps connecting an upper portion of each of the front and rear torso panels together;

a waist belt mounted to at least one of the front and rear torso panels and positioned to extend around at least a portion of a wearer's waist area and connecting a lower portion of each of the front and rear torso panels together, said waist belt having first and second end portions;

a first connector system adapted for attaching the first and second waist belt end portions together in a manual release mode;

a second connector system adapted for attaching the first and second waist belt end portions together in a quick release mode;

wherein at least one of the first and second connector systems connecting the first and second waist belt end portions together; and wherein the second connector system including a retainer device having a portion adjacent the rear torso panel, at least one second connector device and at least one second attachment device operably associated with a respective said second connector device whereby cooperative engagement between the retainer device and the at least one said second device being operable for releasably connecting the first and second waist belt end portions together.

2. The garment of claim 1 wherein the first connector system including at least one first connector device associated with each of the first and second waist belt end portions, said first connector devices each having a first opening, said first connector system including a first attachment device operable to be received through a said first opening in each said first connector device associated with each of said first and second waist belt end portions.

3. The garment of claim 2 wherein the first attachment device including a flexible cord.

4. The garment of claim 3 including a plurality of said first connector devices attached to each of the first and second waist belt end portions and including a plurality of runs of said cord extending between the first and second waist belt end portions.

5. The garment of claim 2 wherein the first attachment device including a flexible stretch cord.

6. The garment of claim 1 wherein the retainer device including a pull cord and a handle connected to the pull cord, said pull cord being carried at least partially by a portion of the waist belt.

7. The garment of claim 6 wherein the at least one second connector device including at least one loop secured to the second end portion of the waist belt and operable to receive a portion of the pull cord therethrough and the at least one second attachment device having at least one opening associated therewith for receipt of a respective loop therethrough, said at least one second attachment device being attached to the first waist belt end portion.

8. The garment of claim 7 wherein the at least one second attachment device being attached to the first waist belt end portion by a flexible cord when connected thereto, said flexible cord being part of the first connector system.

9. The garment of claim 8 including a plurality of said loops and a plurality of said openings associated with the at least one second attachment device.

10. The garment of claim 8 wherein the flexible cord being operable to selectively connect the first and second waist belt end portions together by cooperation with parts of the first connector system or parts of the second connector system.

11. The garment of claim 1 wherein the waist belt having first and second side portions with the first side portion including the first end portion and the second side portion including the second end portion, said first side portion including a third end portion and said second side portion including a fourth end portion, said third and fourth end portions being positioned adjacent a central portion of the front torso panel.

12. The garment of claim 1 including means for mounting armor to the waist belt.

13. The garment of claim 12 including armor mounted to the waist belt using said means.

14. The garment of claim 12 wherein the means including a sleeve in the waist belt.

15. The garment of claim 14 wherein the sleeve extending along a substantial portion of the length of the waist belt.

16. The garment of claim 15 wherein the waist belt having first and second side portions with the first side portion including the first end waist belt portion and the second side portion including the second waist belt end portion, each said waist belt side portion including a respective portion of the sleeve.

17. The garment of claim 16 wherein the first waist belt side portion including a third end portion and the second waist belt side portion including a fourth end portion, said third and fourth end portions being positioned adjacent a central portion of the front torso panel.

18. A vest comprising:

a front torso panel;

a rear torso panel;

a pair of shoulder straps connecting an upper portion of each of the front and rear torso panels together;

a waist belt secured to at least one of the front and rear torso panels and positioned to extend around at least a portion of a wearer's waist area and connecting a lower portion of each of the front and rear torso panels together, said waist belt having at first and second side portions each with a front end portion and a rear end portion and a respective sleeve; and at least one flexible armor member retained in at least one of said sleeves and generally conformable to the contour of the wearer adjacent a lower portion of the front and rear torso panels.

19. The vest of claim 18 wherein the waist belt rear end portions being connected together with a first connector system, each said waist belt side portion having a respective said armor member in a respective said sleeve.

20. The vest of claim 19 wherein each of said first and second waist belt side portions having an opening into the respective sleeve adjacent a respective said waist belt front end portion for receiving a respective armor member therethrough.

21. The vest of claim 20 including a second connector system adapted for attaching the waist belt rear end portions together in a quick release mode and wherein at least one of the first and second connector systems connecting the waist belt rear end portions together.

22. A quick release garment comprising:

at least one torso member;

a waist belt mounted to said torso member and positioned to extend around at least a portion of a wearer's waist area, said waist belt having first and second end portions adjacent said torso member; and a connector system adapted for releasably connecting the first and second waist belt end portions together, said connector system including first and second attachment devices operable to connect the first and second waist belt end portions together in at least two alternate modes of connection, said first attachment device including an adapter and said connector system further including a retainer device operably connected to the adapter to connect the first and second waist belt end portions together in a quick release mode.

23. The garment of claim 22 wherein the second attachment device including a cord operably connected to the first waist belt end portion and one of the adapter and the second waist belt end portion.

24. The garment of claim 23 wherein the connector system including at least one first loop secured to the first waist belt end portion, at least one second loop secured to the adapter, and at least one third loop and at least one fourth loop secured to the second waist belt end portion.

25. The garment of claim 24 wherein the cord being operably associated with the at least one first loop and with the at least one second loop or the at least one third loop, and the at least one fourth loop being operably associated with the adapter, said retainer device operable to releasably retain the at least one fourth loop operably associated with the adapter.

26. The garment of claim 25 including at least two torso members and the garment including a vest with one said torso member being a front torso member and another said torso member being a rear torso member.

27. A garment comprising:

at least one torso portion;

a waist belt associated with said at least one torso portion and positioned to extend around at least a portion of a wearer's waist, said waist belt having first and second end portions;

an adapter member having at least two end portions, one of said adapter member end portions being connectable with the first end portion of said waist belt and the other adapter end portion being connectable with the second end portion of said waist belt; and a retainer member operatively associated with said adapter member and with one of said first and second waist belt end portions for releasably connecting said adapter member to one of said first and second waist belt end portions whereby at least a portion of said retainer member is movable to release said adapter member from said one of said first and second waist belt end portions thereby disconnecting the first and second end portions of said waist belt.

28. The garment of claim 27 wherein each of said first and second waist belt end portions includes at least one connector device, and wherein each of said adapter member end portions includes at least one connector device, at least one of said connector devices associated with one of said first and second waist belt end portions being operatively associated with at least one of the connector devices associated with one of said adapter member end portions whereby cooperative engagement between said retainer member and at least one of said adapter and waist belt connector devices being operable for releasably connecting said adapter member to one of said first and second waist belt end portions.

29. The garment of claim 28 wherein the at least one connector device associated with one of said first and second waist belt end portions includes a loop, and wherein the at least one connector device associated with at least one end portion of said adapter member includes an opening, said loop being extendable through said opening and said retainer member being engageable with said loop.

30. The garment of claim 29 including an attachment device engageable with the at least one connector device associated with the other of said first and second waist belt end portions and with the at least one connector device associated with the other of said adapter member end portions.

31. The garment of claim 30 wherein said attachment device includes a flexible cord.

32. A garment comprising:

at least one torso portion;

a waist belt associated with said at least one torso portion and positioned to extend around at least a portion of a wearer's waist, said waist belt having first and second end portions;

an adapter member having one end portion connectable with one of said first and second waist belt end portions and having another end portion connectable with the other of said first and second waist belt end portions, and wherein one of said adapter member end portions is releasably connectable with one of said first and second waist belt end portions for disconnecting said first and second waist belt end portions; and a retainer member operatively connected to the releasable end portion of said adapter member and to the releasable one of said first and second waist belt end portions, said retainer member being movable to release said adapter member from said one of said first and second waist belt end portions.

33. The garment of claim 32 wherein said retainer member includes a pull cord accessible from a location remote from said adapter member.

34. The garment of claim 33 wherein said first and second waist belt end portions each include at least one connector device, and wherein at least one end portion of said adapter member includes at least one opening extending therethrough, one of the connector devices associated with one of said first and second waist belt end portions being extendable through the at least one opening associated with said adapter member, and said retainer member being cooperatively engageable with the connector device extending through the at least one opening associated with said adapter member.

35. A vest comprising:

a front torso panel;

a rear torso panel;

a pair of shoulder straps connecting an upper portion of each of the front and rear torso panels together;

a waist belt secured to at least one of the front and rear torso panels and positioned to extend around at least a portion of a wearer's waist area and connecting a lower portion of each of the front and rear torso panels together, said waist belt having first and second side portions each with a front end portion and a rear end portion and a respective longitudinally extending sleeve; and at least one flexible armor member retained in at least one said sleeve and generally conformable to the contour of the wearer adjacent a lower portion of the front and rear torso panels.

36. A quick release garment comprising:

at least one torso member;

a waist belt mounted to said torso member and positioned to extend around at least a portion of a wearer's waist area, said waist belt having first and second end portions adjacent said torso member; and a connector system adapted for releasably connecting the first and second waist belt end portions together, said connector system including first and second attachment devices operable to connect the first and second waist belt end portions together in at least two alternate modes of connection;

said first attachment device including an adapter and the connector system further including a retainer device operably connected to the adapter to connect the first and second waist belt end portions together in a quick release mode.

* * * * *